US008356867B2

(12) United States Patent
Lee et al.

(10) Patent No.: US 8,356,867 B2
(45) Date of Patent: Jan. 22, 2013

(54) INKJET IMAGE FORMING APPARATUS AND METHOD OF CONTROLLING INK FLOW

(75) Inventors: In Su Lee, Suwon-si (KR); Jin Ho Park, Yongin-si (KR); Sung Wook Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 706 days.

(21) Appl. No.: 12/425,452

(22) Filed: Apr. 17, 2009

(65) Prior Publication Data

US 2009/0267976 A1 Oct. 29, 2009

(30) Foreign Application Priority Data

Apr. 29, 2008 (KR) ..... 10-2008-39985

(51) Int. Cl.
*B41J 29/38* (2006.01)
*B41J 2/19* (2006.01)
*B41J 2/175* (2006.01)

(52) U.S. Cl. ..... 347/6; 347/92; 347/93

(58) Field of Classification Search ..... 347/6–7, 347/92–93, 84–86
See application file for complete search history.

(56) References Cited

U.S. PATENT DOCUMENTS

| | | | | |
|---|---|---|---|---|
| 6,062,681 | A * | 5/2000 | Field et al. | 347/65 |
| 7,661,803 | B2 * | 2/2010 | Morgan et al. | 347/85 |
| 2007/0120913 | A1 * | 5/2007 | Mukai et al. | 347/93 |
| 2007/0263032 | A1 * | 11/2007 | Sekiguchi | 347/44 |
| 2008/0273070 | A1 * | 11/2008 | Mun et al. | 347/92 |

FOREIGN PATENT DOCUMENTS

JP 2006-051832 2/2006

* cited by examiner

*Primary Examiner* — Jason Uhlenhake
(74) *Attorney, Agent, or Firm* — Stanzione & Kim, LLP

(57) ABSTRACT

An inkjet image forming apparatus includes a print head, an ink tank to store ink, an ink feeding path to feed the ink from the ink tank to the print head, a filter disposed on the ink feeding path, and a press unit disposed on the ink feeding path between the filter and the print head, to press the ink present in the ink feeding path toward the ink tank. The press unit repeats a first operation to press the ink in the ink feeding path toward the ink tank, and a second operation to suck the ink in the ink feeding path.

21 Claims, 6 Drawing Sheets

INKJET IMAGE FORMING APPARATUS AND METHOD OF CONTROLLING INK FLOW

CROSS-REFERENCE TO RELATED APPLICATIONS

This application claims priority under 35 U.S.C. §119(a) from Korean Patent Application No. 2008-0039985, filed on Apr. 29, 2008 in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and, more particularly, to an inkjet image forming apparatus to efficiently remove gas present upstream of a filter on an ink path, and a method of controlling ink flow.

2. Description of the Related Art

Image forming apparatuses serve to develop an image on a printing medium according to an input image signal, and include printers, copiers, facsimiles, and devices combining functions thereof.

The image forming apparatuses can be classified, according to a printing method thereof, into electro-photographic image forming apparatuses and inkjet image forming apparatuses. Inkjet image forming apparatuses are adapted to print an image by discharging fine droplets of ink on a printing medium at desired positions.

Such an inkjet image forming apparatus includes an ink tank in which ink is stored, a print head having nozzles to inject ink onto a printing medium, and an ink path to connect the ink tank and the print head to each other.

If ink to be fed to the print head contains impurities such as dust, the nozzles provided in the print head become clogged with the ink, causing damage to the print head or a deterioration in printing quality. To solve this problem, a filter is disposed on the ink path, to remove impurities contained in the ink.

Meanwhile, air bubbles are present in the ink path because gas is introduced into the ink path. For example, air bubbles in the ink path may be generated as outside air is introduced into the ink path upon detachment/attachment of the ink tank, or may be generated as gas dissolved in the ink is separated from the ink.

The air bubbles present in the ink path have negative effects upon operation of the inkjet image forming apparatus. In particular, when ink containing a lot of air bubbles passes through the filter, a significant pressure drop occurs, preventing the ink from being smoothly fed into the print head and resulting in printing failure. Moreover, an interior pressure of the ink path exhibits an uneven variation while the ink passes through the filter, and this makes controlling an ink discharge operation of the print head is difficult.

To solve the above-described problems, removing air bubbles present upstream of the filter at an appropriate time (for example, during a warm-up operation of the image forming apparatus or prior to beginning a printing operation according to a printing command) is necessary.

As a conventional solution in relation to the above-described problems, Japanese Patent Laid-open Publication No. 2006-0051832 relates to a method of removing air bubbles using a suction force of a pump after capping a nozzle section of a print head. When a negative pressure is applied to the nozzle section and an ink path via operation of the pump, air bubbles present upstream of a filter forcibly pass through the filter, thereby being discharged to the outside through nozzles of the print head.

However, with the above-described method, removal of air bubbles requires an excessively high pressure because air bubbles, present upstream of the filter, must pass through the filter in the course of removing air bubbles. This requires the use of a large-scale and large-capacity pump, and is disadvantageous in view of simplification in configuration of the image forming apparatus and costs of the image forming apparatus.

Another problem of the method disclosed in the above document is that ink is discharged simultaneously when the pump suctions air bubbles, causing an unnecessary waste of the ink.

In addition, as disclosed in the above document, methods using the pump cannot be easily applied to a print head (a so-called array print head) in which a nozzle section has a length corresponding to a width of a printing medium.

SUMMARY OF THE INVENTION

The present general inventive concept provides an inkjet image forming apparatus to remove gas present upstream of a filter by applying a relatively low pressure into an ink path, and a method of controlling ink flow.

The present general inventive concept provides an inkjet image forming apparatus to remove gas present upstream of a filter without waste of ink, and a method of controlling ink flow.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an inkjet image forming apparatus including a print head, an ink tank to store ink, an ink feeding path to feed the ink from the ink tank to the print head, a filter disposed on the ink feeding path, and a press unit disposed on the ink feeding path between the filter and the print head, and to press the ink present in the ink feeding path toward the ink tank.

The press unit may repeat a first operation to press the ink in the ink feeding path toward the ink tank, and a second operation to suck the ink in the ink feeding path.

The press unit may function to open or close the ink feeding path.

The press unit may include a diaphragm valve to open or close the ink feeding path.

The inkjet image forming apparatus may further include a pressure sensor to measure a pressure of the ink having passed through the filter.

The inkjet image forming apparatus may further include a control unit to control the press unit, and the control unit may control the press unit when the pressure measured by the pressure sensor is less than or equal to a reference value, to press the ink in the ink feeding path toward the ink tank.

The press unit may include a housing, a diaphragm to define a variable space within the housing, an orifice to connect the variable space to the ink feeding path, and an opening/closing member to open or close the orifice so as to cause ink to flow.

The inkjet image forming apparatus may further include a pressure regulator disposed between the press unit and the print head, and to regulate flow of the ink to be fed to the print head, and the pressure regulator may block the ink to be directed to the print head when the press unit presses the ink in the ink feeding path.

The foregoing and/or other aspects and utilities of the general inventive concept may also be achieved by providing an inkjet image forming apparatus including a print head, an ink tank to store ink, an ink feeding path to feed the ink from the ink tank to the print head, a filter disposed on the ink feeding path, and a valve disposed between the filter and the print head, the valve being used to open or close the ink feeding path and to press the ink present in the ink feeding path toward the filter so as to collect the gas, present between the filter and the ink tank, into the ink tank.

The valve may repeatedly open or close the ink feeding path, and to collect the gas into the ink tank.

The foregoing and/or other aspects and utilities of the general inventive concept may also be achieved by providing an inkjet image forming apparatus including an ink tank to store ink, a print head to discharge the ink onto a printing medium, an ink circulating path to circulate the ink between the ink tank and the print head, a pump disposed on the ink circulating path, a filter disposed on the ink circulating path, to filter the ink to be fed to the print head, a valve disposed between the filter and the print head, and a control unit to control the pump and the valve, and the control unit may control the valve, to perform a gas removal mode in which the valve causes the ink to flow toward the filter.

The control unit may control the valve such that the valve repeats opening/closing operations.

The inkjet image forming apparatus may further include a pressure sensor to measure a pressure of the ink between the filter and the valve, and the control unit may perform the gas removal mode when the pressure measured by the pressure sensor is less than or equal to a reference value.

The control unit may perform a circulation mode to circulate the ink by opening the valve and operating the pump.

The control unit may perform the gas removal mode prior to performing the circulation mode.

The foregoing and/or other aspects and utilities of the general inventive concept may also be achieved by providing a method of controlling ink flow in an inkjet image forming apparatus including an ink feeding path to feed ink from an ink tank to a print head and a filter disposed on the ink feeding path, the method including collecting gas, present upstream of the filter, into the ink tank by causing the ink, present in the ink feeding path between the filter and the print head, to flow toward the filter.

The ink flow toward the filter may be caused by controlling a valve disposed between the filter and the print head.

The gas may be collected into the ink tank as the valve repeats opening/closing operations.

The ink flow control method may further include measuring a pressure of the ink downstream of the filter.

The ink flow toward the filter may be caused when the pressure, measured downstream of the filter, is less than or equal to a reference value.

The foregoing and/or other aspects and utilities of the general inventive concept may also be achieved by providing a method of controlling ink flow in an inkjet image forming apparatus including an ink circulating path to circulate ink between an ink tank and a print head, a pump disposed on the ink circulating path, and a filter to filter the ink to be fed to the print head, the method including collecting gas, present between the filter and the ink tank, into the ink tank by causing the ink, present in the ink circulating path between the filter and the print head, to flow toward the filter, and circulating the ink through the ink circulating path via operation of the pump.

The foregoing and/or other aspects and utilities of the general inventive concept may also be achieved by providing an inkjet image forming apparatus including a print head and an ink tank, the apparatus including an ink feeding path to feed ink between the ink tank to the print head, and a press unit at least one of press the ink in the ink feeding path toward the ink tank and suck the ink in the ink feeding path based on an amount of pressure of the ink in the ink feeding path.

The ink jet image forming apparatus may also include a pressure sensor to measure the pressure of the ink in the ink feeding path.

The foregoing and/or other aspects and utilities of the general inventive concept may also be achieved by providing a computer-readable recording medium having embodied thereon a computer program to execute a method, wherein the method including causing ink present in an ink feeding path between a filter and a print head to flow toward the filter, and collecting gas present upstream of the filter into the ink tank.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
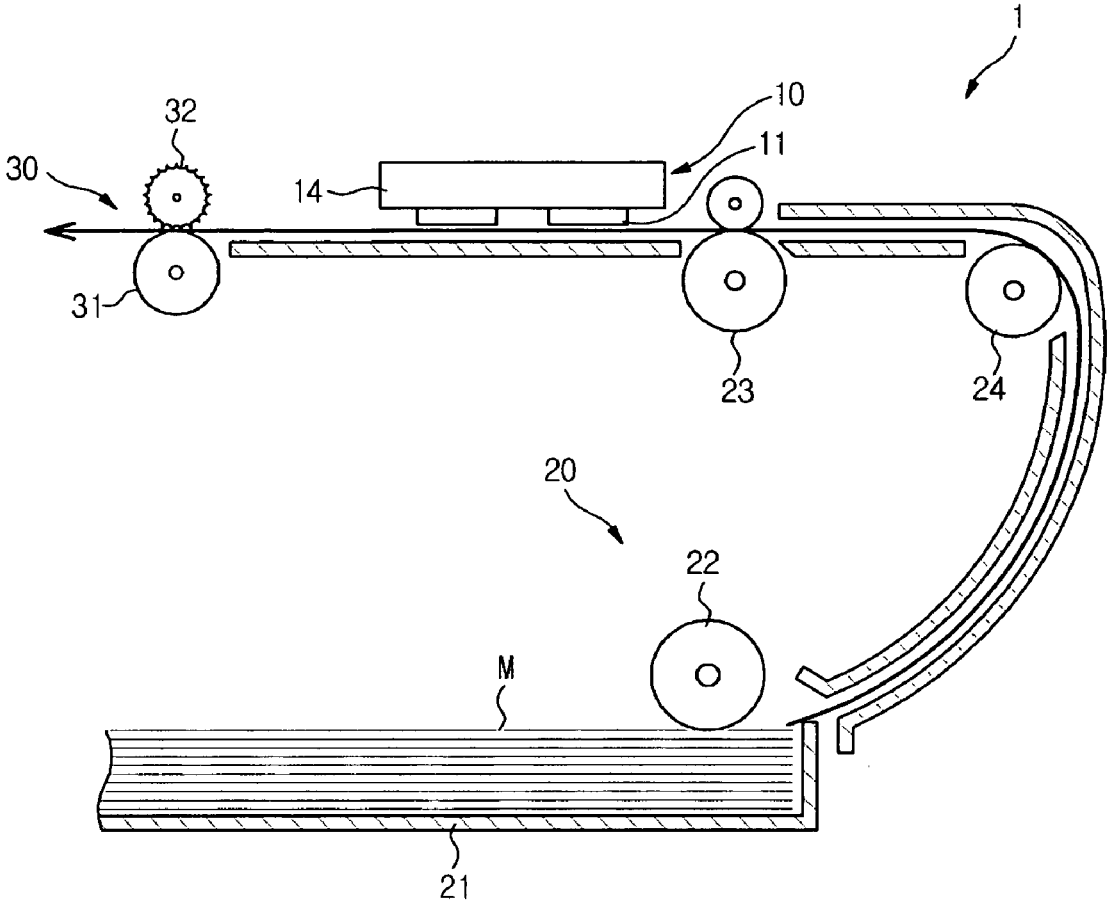
FIG. 1 is a view illustrating a configuration of an inkjet image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a view illustrating a configuration of an inkjet image forming apparatus in accordance with an embodiment of the present general inventive concept. As illustrated in FIG. 1, the inkjet image forming apparatus 1 includes a print head 10, a printing medium feeding unit 20, and a printing medium discharge unit 30.

The print head 10 forms an image by ejecting ink onto a printing medium M according to an image signal. In the present embodiment, the print head 10 is an array print head including a nozzle section 11, which has a length corresponding to a width of the printing medium M. The print head 10 further includes a channel unit 14 having one or more channel plates having one or more channels as ink paths to supply one or more color inks to the corresponding nozzle section 11. The print head 10 ejects ink onto the printing medium M at a fixed position, printing an image.

Figure 2:
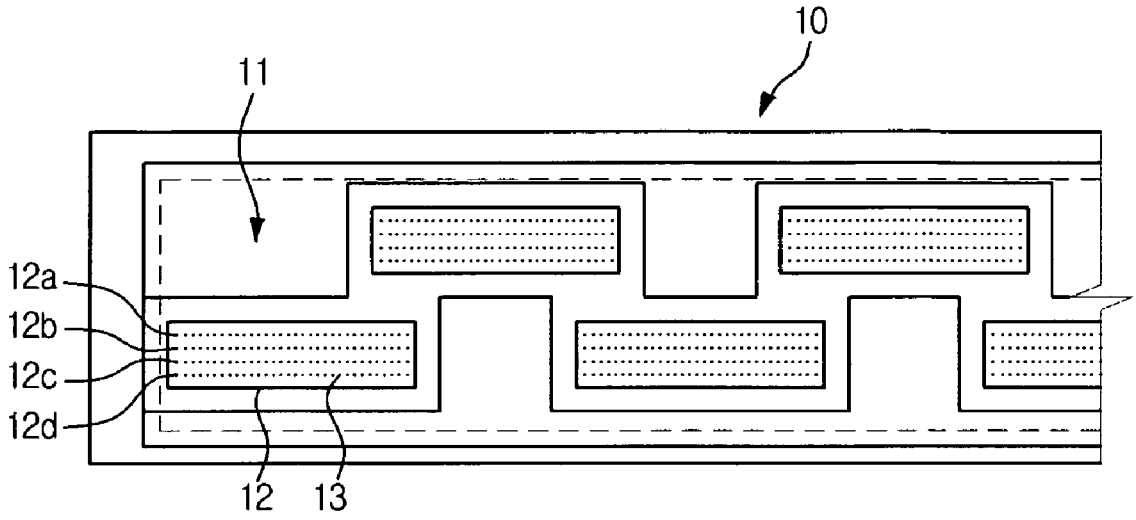
FIG. 2 is a view illustrating a nozzle section of a print head provided in the inkjet image forming apparatus of FIG. 1.

FIG. 2 is a view illustrating the nozzle section 11 of a print head provided in the inkjet image forming apparatus of FIG. 1. As illustrated in FIG. 2, the nozzle section 11 includes a plurality of head chips 12 arranged in a longitudinal direction of the print head 10. The head chips 12 can be arranged in a zigzag pattern.

Referring to FIGS. 1 and 2, each of the head chips 12 includes nozzle rows 12*a*, 12*b*, 12*c* and 12*d* each including a plurality of nozzles 13 to eject ink. The respective nozzle rows 12*a*, 12*b*, 12*c* and 12*d* can eject a same color of ink or different colors of ink (for example, cyan, magenta, yellow and black).

The print head 10 further includes the channel unit 14 to guide ink to be fed to the nozzles 13. The channel unit 14 is internally defined with an ink channel (not illustrated) to uniformly feed ink to the nozzles 13 of the print head 10.

The printing medium feeding unit 20 feeds the printing medium M toward the print head 10. The printing medium feeding unit 20 can include a loading tray 21, a pickup roller 22, a feeding roller 23, and an auxiliary roller 24.

The pickup roller 22 picks up printing media stored in the loading tray 21 sheet by sheet, and the auxiliary roller 24 conveys the picked printing medium to the feeding roller 23. The feeding roller 23 feeds the printing medium to a position below the print head 10, to prepare a printing operation.

The printing medium discharge unit 30 serves to discharge the printing medium upon complication of the printing operation to the outside of the image forming apparatus 1. The printing medium discharge unit 30 can include a discharge roller 31, and a star-wheel 32 disposed opposite the discharge roller 31. The star-wheel 32 serves not only to prevent the printing medium M from coming into contact with the nozzle section 11 while passing below the nozzle section 11, but also to prevent a variation in distance between the printing medium M and the nozzle section 11.

The inkjet image forming apparatus 1 further includes an ink feeding device to feed ink into the print head 10. The ink feeding device takes a form of a cartridge, and may be formed integrally with or separately from the print head 10.

Figure 3:
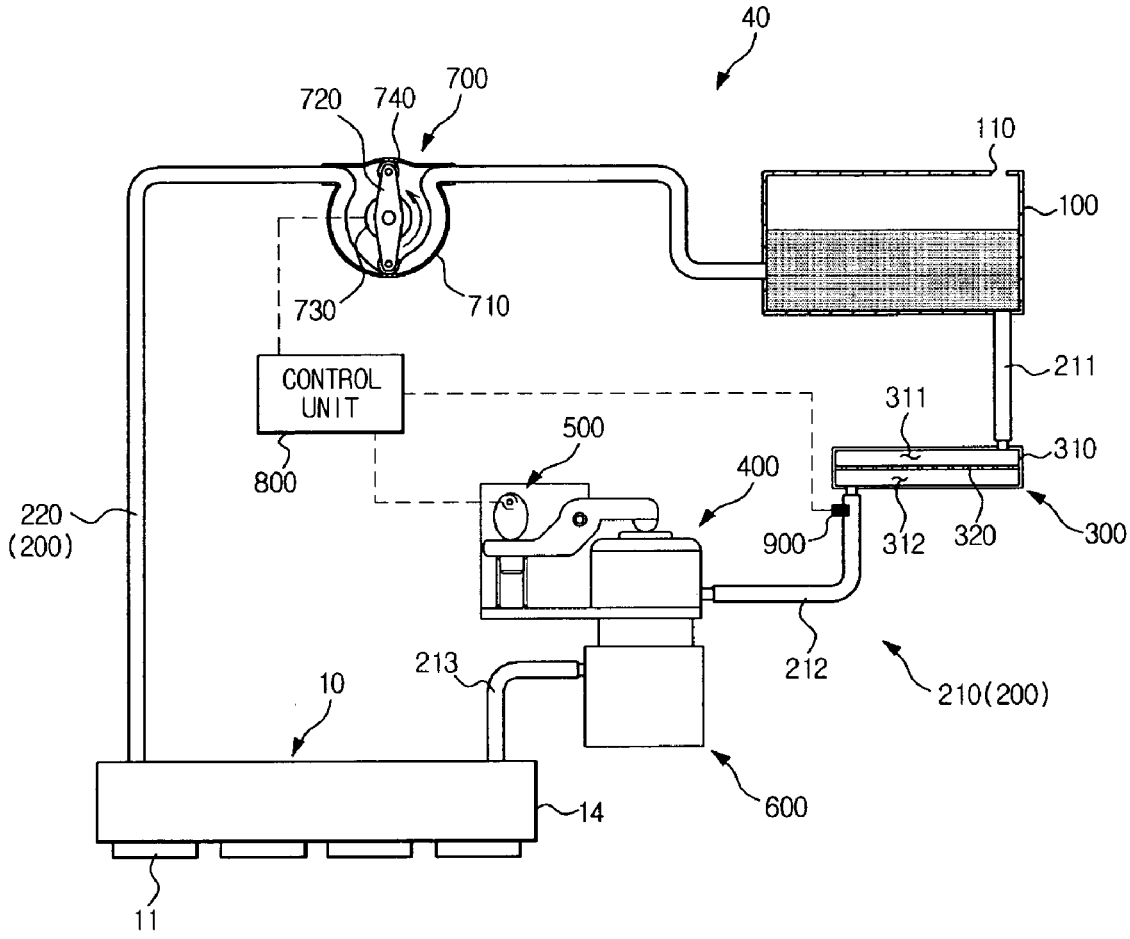
FIG. 3 is a view illustrating configuration of an ink feeding device provided in the inkjet image forming apparatus in accordance with an embodiment of the present general inventive concept.
Figure 4:
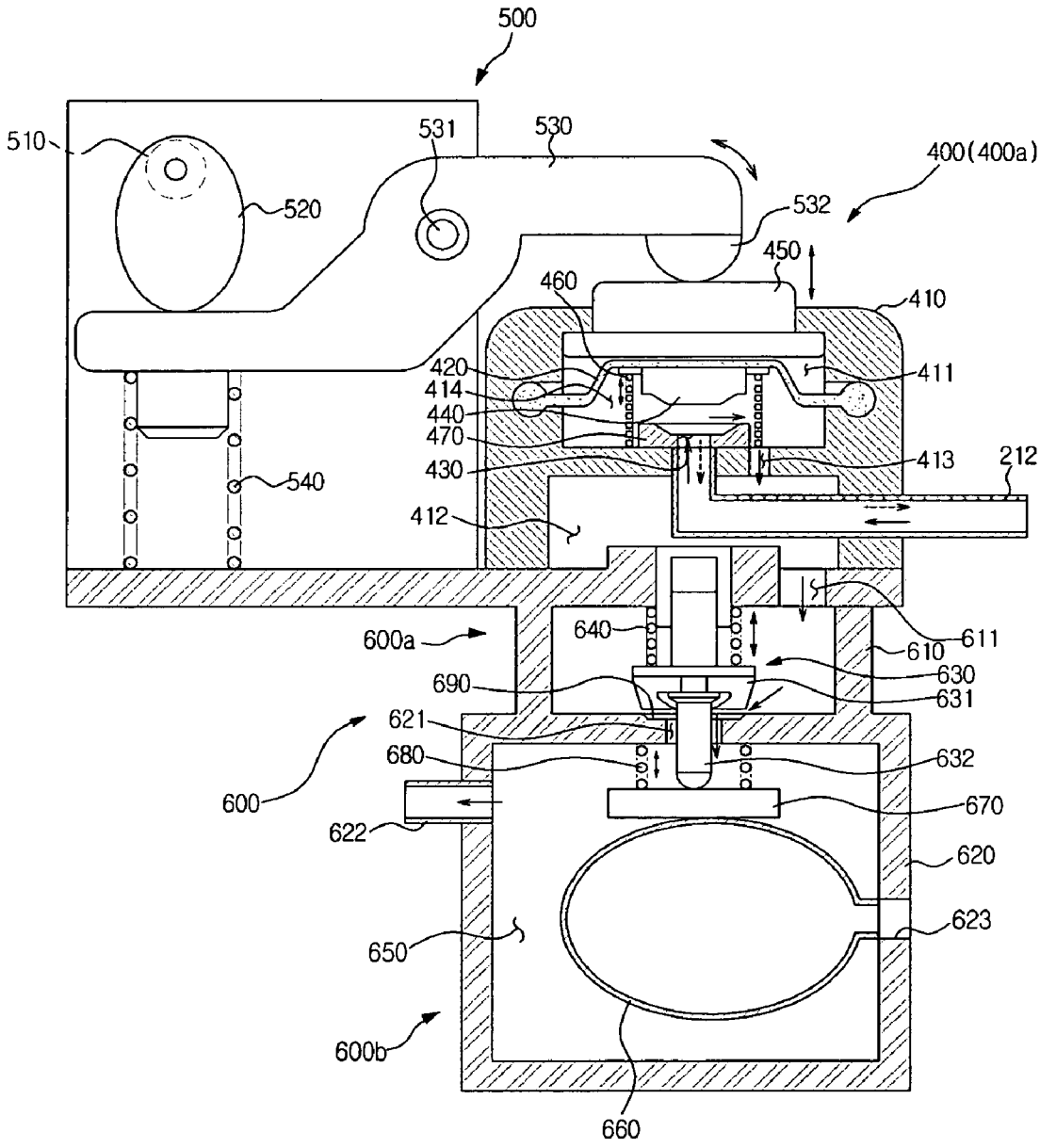
FIG. 4 is a view illustrating a configurations of a press unit, a pressure regulator, and a drive unit illustrated in FIG. 3.

FIG. 3 is a view illustrating a configuration of the ink feeding device provided in the inkjet image forming apparatus in accordance with an embodiment of the present general inventive concept. FIG. 4 is a view illustrating configurations of a press unit, a pressure regulator, and a drive unit illustrated in FIG. 3.

As illustrated in FIG. 3, the ink feeding device 40 includes an ink tank 100, an ink circulating path 200, a filter unit 300, a press unit 400, a pressure regulator 600, a pump 700, and a control unit 800.

The ink tank 100 stores ink to be fed to the print head 10, and the ink circulating path 200 connects the ink tank 100 and the print head 10 to each other, to allow the ink stored in the ink tank 100 to be circulated by the print head 10.

The ink circulating path 200 includes an ink feeding path 210 to feed the ink in the ink tank 100 to the print head 10, and an ink collecting path 220 to collect the ink, having passed through the print head 10, into the ink tank 100. Hereinafter, classifying the ink feeding path 210 is necessary, a path between the ink tank 100 and the filter unit 300 is referred to as a first feeding path 211, a path between the filter unit 300 and the press unit 400 is referred to as a second feeding path 212, and a path between the pressure regulator 600 and the print head 10 is referred to as a third feeding path 213.

The ink tank 100 has an exhaust hole 110 to communicate with the atmosphere. When the image forming apparatus 1 performs a circulation mode or a gas removal mode, gas, present within the ink circulating path 200, is collected into the ink tank 100 and then, is discharged to the outside through the exhaust hole 110. The circulation mode and the gas removal mode of the image forming apparatus 1 (FIG. 1) will be described hereinafter in detail.

The filter unit 300 is disposed on the ink feeding path 210 and serves to remove impurities from the ink to be fed to the print head 10. The filter unit 300 includes a filter housing 310 defining a predetermined space therein, and a filter 320 disposed in the filter housing 310. The filter 320 divides an interior space of the filter housing 310 into a filter inlet portion 311 and a filter outlet portion 312.

The press unit 400 is disposed on the ink feeding path 210 between the filter unit 300 and the print head 10. The press unit 400 serves to press the ink in the second feeding path 212 toward the ink tank 100, so as to collect the ink, present upstream of the filter 320, into the ink tank 100.

When the press unit 400 presses the ink in the second feeding path 212, ink flow toward the filter unit 300 occurs in the second feeding path 212, causing gas present upstream of the filter 320, i.e. present between the filter inlet portion 311 and the first feeding path 211 to be collected into the ink tank 100. The gas collected in the ink tank 100 is discharged to the outside through the exhaust hole 110 of the ink tank 100.

Moving the gas present upstream of the filter 320 toward the ink tank 200 for gas removal allows easy removal of gas even with a low pressure because air bubbles are not passed through the filter 320. In addition, no ink is discharged together with the removal of air bubbles, eliminating ink waste.

In the present embodiment, in addition to removing the gas present upstream of the filter 320, the press unit 400 can serve as a valve to open or close the ink feeding path 210. The press unit 400 can reliably close the ink feeding path 210 when the image forming apparatus 1 is not in operation, thereby preventing the ink from leaking through the print head 10.

The press unit 400, as illustrated in FIG. 4, can take a form of a diaphragm valve 400*a*. The diaphragm valve 400*a* includes a housing 410, a diaphragm 420, an orifice 430, an opening/closing member 440, a press member 450, and an elastic member 460.

An interior of the housing 410 is divided into an upper space 411 and a lower space 412, and the upper and lower spaces 411 and 412 are connected to each other via a channel 413.

The diaphragm 420 is disposed in the upper space 411 of the housing 410. The diaphragm 420 is made of a flexible material or elastically deformable material, to define a variable space 414 within the housing 410. A valve seat 470 formed with the orifice 430 is disposed in the variable space 414. The variable space 414 communicates with the second feeding path 212 via the orifice 430 and also, communicates with the lower space 412 via the channel 413.

The opening/closing member 440 reciprocates in the variable space 414, to open or close the orifice 430. Although FIG. 4 illustrates an example in which the opening/closing member 440 is attached to a ceiling surface of the diaphragm 420, the opening/closing member 440 may be integrally formed with the diaphragm 420.

The press member 450 is disposed on the diaphragm 420 in a reciprocally movable manner, and the elastic member 460 is disposed opposite the press member 450 to elastically support the diaphragm 420.

When the press member 450 moves downward to thereby press the diaphragm 420, the opening/closing member 440 closes the orifice 430, blocking ink flow. When the press member 450 moves upward to release a press force applied to the diaphragm 420, the diaphragm 420 is returned to an original position thereof by an elastic force of the elastic member 460, causing the opening/closing member 440 to open the orifice 430. Once the orifice 430 is opened, the ink in the second feeding path 212 passes through the orifice 430, variable space 414, channel 413 and lower space 412 in sequence, thereby being fed toward the print head 10 (See ink flow represented by solid line arrows).

Meanwhile, when the press member 450 moves downward to thereby press the diaphragm 420, the diaphragm 420 is deformed to reduce a volume of the variable space 414, causing the ink in the variable space 414 to move toward the filter unit 300 through the second feeding path 212 (See ink flow represented by dotted line arrows). Then, if the press member 450 moves upward to return the diaphragm 420 to an original position thereof, the variable space 414 increases in volume, causing the ink in the second feeding path 212 to be introduced into the variable space 414.

The press unit 400 is driven by a drive unit 500. As illustrated in FIG. 4, the drive unit 500 includes a drive motor 510, a cam 520, and a lever 530.

The cam 520 is rotated upon receiving power from the drive motor 510. The lever 530 is rotated about a rotating shaft 531 by the cam 520, to operate the press member 450 of the press unit 400. The lever 530 is provided at one end thereof with a press portion 532 to press the press member 450, and an other end of the lever 530 is elastically supported by a press spring 540.

When the cam 520 pushes the other end of the lever 530 as illustrated in FIG. 4, the press portion 532 does not apply force to the press member 450, causing the opening/closing member 440 to be spaced apart from the valve seat 470 and the orifice 430 to be opened. Alternatively, when the cam 520 is rotated to remove the press force applied to the other end of the lever 530, the lever 530 is rotated by an elastic force of the press spring 540 to press the press member 450 by the press portion 532 of the lever 530. Thereby, the diaphragm 420 is pushed downward, causing the opening/closing member 440 to close the orifice 430.

Although the present embodiment describes an example in which the press unit 400 takes a form of the diaphragm valve 400*a*, the press unit 400 can be adapted into various other configurations so long as the press unit 400 can cause the ink to flow toward the filter 320 and the ink tank 100 by pressing the ink in the ink feeding path 210 downstream of the filter 320. For example, a solenoid valve to reciprocate the opening/closing member 440 using a solenoid can be applied.

As illustrated in FIGS. 3 and 4, the pressure regulator 600 is disposed on the ink feeding path 210 between the press unit 400 and the print head 10. The pressure regulator 600 regulates ink flow in such a manner that ink is fed to the print head 10 only when the ink in the print head 10 is discharged as a predetermined range of negative pressure is applied to the print head 10.

The pressure regulator 600 includes a valve unit 600*a* and a regulating unit 600*b*. The valve unit 600*a* includes a valve housing 610 connected to the housing 410 of the press unit 400 via a channel 611, and the regulating unit 600*b* includes a chamber housing 620 connected to the valve housing 610 via an orifice 621.

The orifice 621 is opened or closed by an opening/closing member 630 that is disposed in the valve housing 610. The opening/closing member 630 includes a body 631 to open or close the orifice 621 and a pole 632 extending into the chamber housing 620 via the orifice 621.

The opening/closing member 630 is elastically supported by a valve spring 640. The valve spring 640 biases the opening/closing member 630 such that the opening/closing member 630 closes the orifice 621.

The chamber housing 620 has an ink exit 622 and an air exit 623. The ink exit 622 is connected to the third feeding path 213 and the air exit 623 communicates with outside air.

The chamber housing 620 includes an ink chamber 650 which communicates with the orifice 621 and the ink exit 622, and an air bag 660 which is disposed in the ink chamber 650 and is connected with the air exit 623.

The air bag 660 is changed in volume according to a pressure variation of the ink chamber 650. If the ink is discharged from the ink chamber 650 and causes a pressure drop in the ink chamber 650, air is introduced into the air bag 660, thereby compensating for the pressure variation of the ink chamber 650. For example, if the ink in the ink chamber 650 is fed into the print head 10 during a printing operation, pressure in the ink chamber 650 decreases. In this case, as air is introduced into the air bag 660 to expand the air bag 660, the decrease in pressure can be compensated for.

The chamber housing 620 incorporates an operating member 670 and an operating spring 680 to press the operating member 670. One side of the operating member 670 comes into contact with the air bag 660 and the other side is elastically supported by the operating spring 680.

The operating member 670 applies a pressure to the air bag 660 filled with air to prevent air from being continuously introduced into the air bag 660, thereby maintaining a predetermined range of negative pressure within the ink chamber 650.

The operating member 670 moves upward upon expansion of the air bag 660, to push up the pole 632 of the opening/closing member 630. As the pole 632 is pushed up, the body 631 of the opening/closing member 630 is spaced apart from the valve seat 690 and the orifice 621 is opened. Thereby, the ink in the valve housing 610 is introduced into the ink chamber 650 through the orifice 621.

The pressure of the ink chamber 650 rises as the ink is introduced into the ink chamber 650, resulting in constriction of the air bag 660. Thereby, the operating member 670 is returned to an original position thereof by an elastic force of the operating spring 680, and the opening/closing member 630 moves downward by the elastic force of the valve spring 640, to close the orifice 621.

As illustrated in FIG. 3, the pump 700 is disposed on the ink collecting path 220. The pump 700 includes a pump body 710 having an arcuate inner peripheral surface, a roller arm 720 disposed in the pump body 710, a pump motor 730 to rotate the roller arm 720, and rollers 740 disposed at opposite ends of the roller arm 720 to press the ink collecting path 220.

Figure 5:
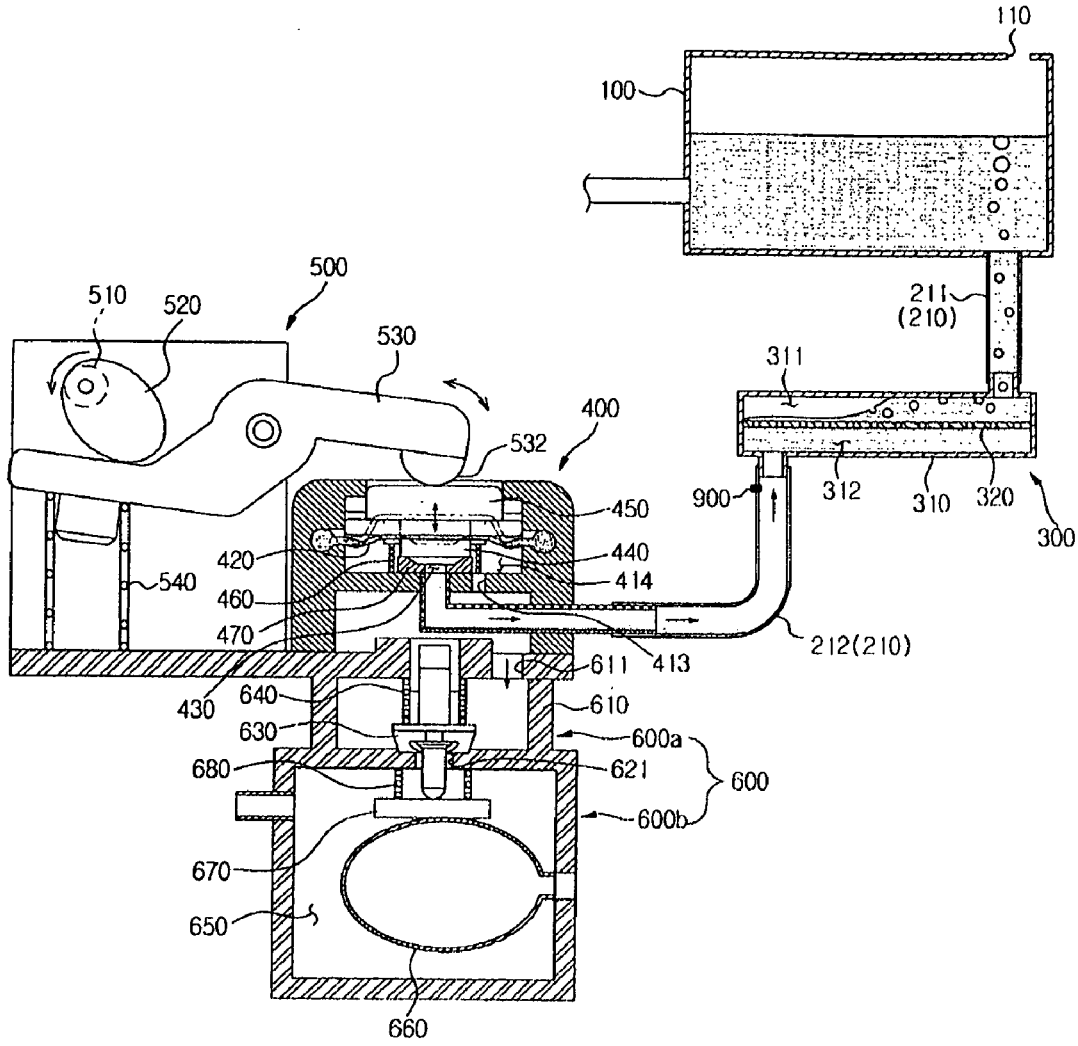
FIG. 5 is a view illustrating a gas removal mode in accordance with an embodiment of the present general inventive concept.

Referring to FIGS. 3 and 5, the control unit 800 controls operations of the press unit 400 and the pump 700 and controls general operation of the image forming apparatus 1.

The control unit 800 can perform the gas removal mode by a controlling operation of the press unit 400 via the drive unit 500. Here, the gas removal mode is an operation to remove gas present in the ink feeding path 210 upstream of the filter 320 by collecting the gas into the ink tank 100.

Further, the control unit 800 can perform the circulation mode to circulate the ink through the ink circulating path 200 by controlling the press unit 400 and the pump 700. With circulation of the ink, gas present in the ink circulating path 200 and the print head 10 can be collected into the ink tank 100 and thereafter, be separated from the ink.

If a great amount of gas is present upstream of the filter 320 when the control unit 800 performs the circulation mode, the ink undergoes a great pressure loss while passing through the filter 320, causing a substantial negative pressure to be applied to the interior of the print head 10. This may cause breakage of an ink meniscus in the nozzles 13 of the print head 10. Accordingly, the gas present upstream of the filter 320 can be removed by performing the gas removal mode prior to performing the circulation mode.

Meanwhile, a pressure sensor 900 can be disposed in the ink feeding path 210 downstream of the filter 320. As illustrated in FIG. 3, the pressure sensor 900, for example, is disposed on the second feeding path 212 at a position adjacent to the filter unit 300.

The pressure sensor 900 measures a pressure of the ink having passed through the filter 320, and transmits the measured result to the control unit 800. The control unit 800 compares the pressure measured by the pressure sensor 900 with a reference value, thereby determining whether the gas removal mode has to be performed.

For example, if the pressure sensor 900 measures a pressure below a reference value during implementation of the circulation mode, the control unit 800 determines that a lot of gas is present upstream of the filter 320, and can perform the gas removal mode after stopping the circulation mode. Also, even when the pressure sensor 900 measures a pressure below a reference value while the image forming apparatus 1 (FIG. 1) performs a printing operation, the control unit 800 can perform the gas removal mode after momentarily stopping the printing operation.

Hereinafter, operation of the inkjet image forming apparatus in accordance with an embodiment of the present general inventive concept will be described in detail with reference to FIGS. 3 to 5 and the following Table 1. FIG. 5 is a view illustrating the gas removal mode. In FIG. 5, for convenience of illustration, of the ink filled in the ink feeding device 40, only the ink, which is present in the ink tank 100, first feeding path 211, filter unit 300, second feeding path 212 and the variable space 414, is illustrated.

TABLE 1

| | Press Unit (Valve) | Pump |
|---|---|---|
| Gas Removal Mode | Repeated Opening/Closing | Stopped |
| Circulation Mode | Open | Pumping |
| Printing Mode | Open | Stopped |
| Idle Mode | Closed | Stopped |

The gas removal mode can be performed when the image forming apparatus 1 is turned on, before a printing operation (printing mode) begins, after a printing operation for one sheet is completed before a printing operation for a subsequent sheet begins, or after a printing operation is finished.

In the gas removal mode, the control unit 800 stops the pump 700, and controls the drive unit 500 such that the press unit 400 repeatedly opens or closes the ink feeding path 210.

More specifically, the control unit 800 controls the drive motor 510 of the drive unit 500, to rotate the cam 520. During rotation of the cam 520, the lever 530 of the drive unit 500 repeats a seesaw motion according to whether the cam 520 presses the lever 530. In this case, the press portion 532 of the lever 530 repeatedly applies a press force to the press member 450 of the press unit 400.

When the lever 530 presses the press member 450, as illustrated in FIG. 5, the diaphragm 420 of the press unit 400 is deformed by the press member 450, and the variable space 414 defined by the diaphragm 420 is reduced in volume. Thereby, the ink in the variable space 414 moves toward the filter unit 300 through the second feeding path 212, applying a pressure to the gas present upstream of the filter 320, i.e. present in the filter inlet portion 311 and the first feeding path 211, so as to collect the gas into the ink tank 100. When the lever 530 presses the press member 450 to the maximum extent, the opening/closing member 440 of the press unit 400 is brought into contact with the valve seat 470, closing the orifice 430.

When the variable space 414 is reduced in volume as described above, a portion of the ink in the variable space 414 moves into the valve housing 610 of the pressure regulator 600 through the channels 413 and 611. However, such an ink flow increases an ink pressure within the valve housing 610, applying a pressure to the opening/closing member 630 of the valve unit 600*a* so as to allow the opening/closing member 630 to close the orifice 621. As a result, once the ink is pressed toward the pressure regulator 600 by the press unit 400, the ink cannot move toward the print head 10, and there is no risk of ink leakage from the print head 10.

Meanwhile, when the lever 530 releases a press force applied to the press member 450, the diaphragm 420 of the press unit 400 is returned to an original position thereof by an elastic force of the elastic member 460. Accordingly, the opening/closing member 440 of the press unit 400 is spaced apart from the valve seat 470, opening the orifice 430 and resulting in an increase in volume of the variable space 414. In this case, the ink in the second feeding path 212 is suctioned into the variable space 414, to again fill the variable space 414.

As the press unit 400 repeats the above-described opening/closing operations via operation of the drive unit 500, the gas present upstream of the filter 320 can be completely collected into the ink tank 100 for gas removal.

The circulation mode, for example, is performed subsequent to the gas removal mode. However, in the case where the circulation mode begins before the gas removal mode, but the pressure sensor 900 measures a pressure below a reference value, the circulation mode is stopped and thereafter, the gas removal mode can be performed.

In the circulation mode, the control unit 800 controls the drive unit 500 such that the press unit 400 keeps the ink feeding path 210 in an opened state. The control unit 800 controls the pump 700, to pump the ink in a direction designated by arrows in FIG. 3. As a negative pressure is produced within the print head 10 due to the resulting pumping force, the ink and the gas within the print head 10 are collected into the ink tank 100 through the ink collecting path 220 and in turn, the ink stored in the ink tank 100 is fed toward the print head 10 through the ink feeding path 210. The gas, collected from the print head 10, is separated form the ink within the ink tank 100, thereby being discharged to the outside through the exhaust hole 110.

In a printing mode to perform a printing mode according to a printing command, the control unit 800 stops the pump 700 and controls the press unit 400 so as to open the ink feeding path 210. In such a state, the print head 10 ejects the ink through the nozzles 13 (See FIG. 2), thereby printing an image on the printing medium M.

After the ink is ejected from the print head 10, a negative pressure within the print head 10 increases so as to feed the ink from the ink chamber 650 of the pressure regulator 600 into the print head 10. As the ink in the ink tank 100 is consumed, air is introduced into the air bag 660 of the pressure regulator 600, to expand the air bag 660. With expansion of the air bag 660, the operating member 670 and the opening/closing member 630 move upward, opening the orifice 621 of the pressure regulator 600. As a result, the ink in the valve housing 610 is fed into the ink chamber 650 through the orifice 621.

Meanwhile, in an idle mode wherein the image forming apparatus 1 is not in operation, the control unit 800 controls the press unit 400, so as to close the ink feeding path 210. Thereby, the feeding of ink into the print head 10 is stopped. Also, even when the pressure regulator 600 malfunctions or is damaged, reliably preventing the ink in the ink tank 100 from falling into the print head 10 is possible.

Figure 6:
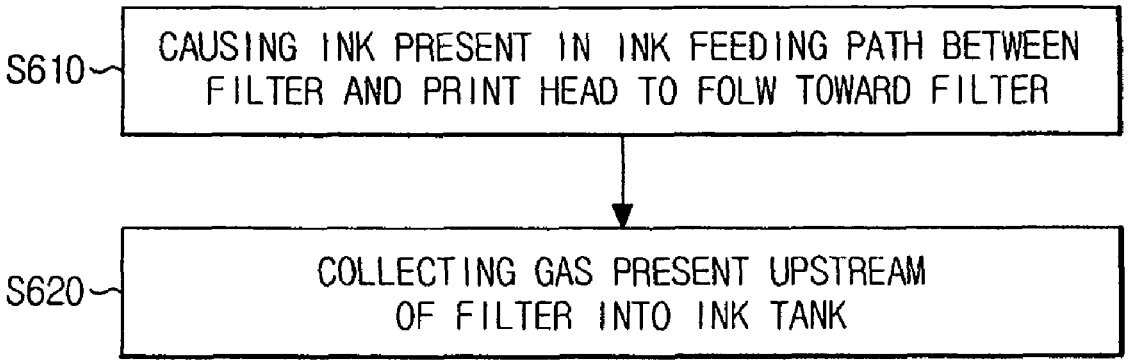
FIG. 6 is a flowchart illustrating a method of controlling ink flow in an inkjet image forming apparatus according to an embodiment of the present general inventive concept.

FIG. 6 is a flowchart illustrating a method of controlling ink flow in an inkjet image forming apparatus according to an embodiment of the present general inventive concept. Referring to FIGS. 1, 3, 5 and 6, according to an embodiment of the present general inventive concept, the inkjet image forming apparatus 1, for example, includes an ink feeding path 210 to feed ink from an ink tank 100 to a print head 10 and a filter 320 disposed on the ink feeding path 210. In operation S610, ink present in the ink feeding path 210 between the filter 320 and the print head 10 is caused to flow toward filter 320. In operation S620, gas present upstream of filter 320 is collected into the ink tank 100. The controlling method can be performed by the control unit 800.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As apparent from the above description, the present general inventive concept provides an inkjet image forming apparatus, wherein gas present in an ink feeding path upstream of a filter can be collected into and removed from an ink tank, whereby air bubbles contained in the ink do not pass through the filter during a gas removal operation. Accordingly, gas can be efficiently removed even with a relatively low pressure, and this enables a simplification in configuration of a gas removal device. As a result, the present general inventive concept is very advantageous from a structural viewpoint of miniaturizing the image forming apparatus or in view of improving price competitiveness via reduced costs of constituent elements.

Further, since the gas can be collected into and removed from the ink tank alone rather than being discharged together with the ink, the present general inventive concept has an effect of preventing unnecessary waste of ink during the gas removal operation.

Furthermore, by removing the gas present upstream of the filter prior to performing a circulation mode, it is possible to prevent breakage of an ink meniscus within a print head during the circulation mode.

Finally, unlike the prior art of forcibly suctioning gas after capping a nozzle section of the print head, according to various embodiments of the present general inventive concept, the gas is removed as a pressure is applied to an interior of an ink feeding path. Such a gas removal method can be easily applied to other inkjet image forming apparatuses using an array print head that has a lengthy nozzle section.

Although embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An inkjet image forming apparatus, comprising:
- a print head;
- an ink tank to store ink;
- an ink feeding path to feed the ink from the ink tank to the print head;
- a filter disposed on the ink feeding path;
- a press unit disposed on the ink feeding path between the filter and the print head and configured to move the ink along the ink feeding path in a first direction, toward the filter, and to move the ink along the feeding path in an opposing second direction, toward the print head; and
- a pressure regulator disposed between the press unit and the print head and configured to block the ink feeding path to prevent the ink from moving in the second direction, when the press unit moves the ink in the first direction.

2. The apparatus according to claim 1, wherein the press unit close the ink feeding path when moving the ink in the first direction, and opens the ink feeding path when moving the ink in the second direction.

3. The apparatus according to claim 1, wherein the press unit comprises:
- a diaphragm valve to open or close the ink feeding path.

4. The apparatus according to claim 1, further comprising:
- a pressure sensor to measure a pressure of the ink having passed through the filter.

5. The apparatus according to claim 4, further comprising:
- a control unit to control the press unit,
- wherein the control unit controls the press unit to move the ink in the ink feeding path toward the ink tank, when the pressure measured by the pressure sensor is less than or equal to a reference value.

6. The apparatus according to claim 1, wherein the press unit comprises:
- a housing;
- a diaphragm to define a variable space within the housing;
- an orifice to connect the variable space to the ink feeding path; and
- an opening/closing member to open or close the orifice so as to cause ink to flow.

7. An inkjet image forming apparatus, comprising:
- a print head;
- an ink tank to store ink;
- an ink feeding path extending from the ink tank to the print head;
- a filter disposed on the ink feeding path;
- an ink collecting path extending from the print head to the ink tank; and
- a press unit disposed on the ink feeding path between the filter and the print head and configured to move the ink along the ink feeding path in a first direction, toward the filter, and to simultaneously move the ink along the feeding path in an opposing second direction, toward the print head.

8. The apparatus according to claim 7, wherein the press unit comprises a valve to open and close the ink feeding path.

9. An inkjet image forming apparatus, comprising:

an ink tank to store ink;

a print head to discharge the ink onto a printing medium;

an ink circulating path to guide the ink between the ink tank and the print head;

a pump disposed on the ink circulating path and configured to move ink along the ink collection path, toward the ink tank;

a filter disposed on the ink circulating path and configured to filter the ink;

a valve disposed on the ink circulating path, between the filter and the print head; and a control unit configured to control the pump and the valve, wherein the control unit controls the valve to perform a gas removal mode, in which the valve causes the ink to flow toward the filter.

10. The apparatus according to claim 9, wherein the control unit controls the valve such that the valve repeats opening/closing operations.

11. The apparatus according to claim 9, further comprising:

a pressure sensor to measure ink pressure between the filter and the valve, wherein the control unit performs the gas removal mode, when the measured ink pressure is less than or equal to a reference value.

12. The apparatus according to claim 9, wherein the control unit performs a circulation mode to circulate the ink through the ink circulating path, by opening the valve and operating the pump.

13. The apparatus according to claim 12, wherein the control unit performs the gas removal mode prior to performing the circulation mode.

14. A method of controlling ink flow in an inkjet image forming apparatus comprising an ink feeding path to feed ink from an ink tank to a print head and a filter disposed on the ink feeding path, the method comprising:

collecting gas, present upstream of the filter, in the ink tank, by moving the ink in the ink feeding path, via a valve between the filter and the print head, toward the filter.

15. The method according to claim 14, wherein the ink movement is controlled by controlling the valve disposed between the filter and the print head.

16. The method according to claim 15, wherein the gas is collected into the ink tank as the valve repeats opening/closing operations.

17. The method according to claim 14, further comprising: measuring a pressure downstream of the filter.

18. The method according to claim 17, wherein the ink is moved toward the filter when the measured ink pressure is less than or equal to a reference value.

19. A method of controlling ink flow in an inkjet image forming apparatus comprising an ink circulating path to circulate ink between an ink tank and a print head, a pump disposed on the ink circulating path, and a filter to filter the ink to be fed to the print head, the method comprising:

collecting gas present between the filter and the ink tank into the ink tank by causing a first portion of the ink present in the ink circulating path between the filter and the print head to flow toward the filter, while simultaneously causing a second portion of the ink present in the ink circulating path between the filter and the print head to flow toward the print head; and circulating the ink through the ink circulating path via operation of the pump.

20. An inkjet image forming apparatus including a print head and an ink tank, the apparatus comprising:

an ink feeding path extending from the ink tank to the print head; and a press unit disposed on the ink feeding path and configured to moved the ink along the ink feeding path in a first direction, toward the filter and to simultaneously move the ink along the feeding path in an opposing second direction, toward the print head, based on ink pressure in in the ink feeding path.

21. The apparatus according to claim 20, further comprising:

a pressure sensor to measure the pressure of the ink in the ink feeding path.

* * * * *